United States Patent [19]

Bruna

[11] 4,363,937

[45] Dec. 14, 1982

[54] SOUND INLET FOR MICROPHONES

[75] Inventor: Bernhard Bruna, Vienna, Austria

[73] Assignee: AKG Akustische u.Kino-Geräte Gesellschaft m.b.H., Austria

[21] Appl. No.: 208,317

[22] Filed: Nov. 19, 1980

[30] Foreign Application Priority Data

Nov. 29, 1979 [AT] Austria ..... 7574/79

[51] Int. Cl.[3] ..... H04R 1/08

[52] U.S. Cl. ..... 179/121 R; 179/179; 181/242

[58] Field of Search ..... 179/121 R, 121 D, 179, 179/180, 184, 133; 181/242, 158

[56] References Cited

U.S. PATENT DOCUMENTS 2,870,856 1/1959 Olson et al. ..... 179/180 X 3,560,668 2/1971 Woming ..... 179/121 R X

FOREIGN PATENT DOCUMENTS 55-96796 7/1980 Japan ..... 179/121 R

OTHER PUBLICATIONS

AKG Microphone Catalog, CB-051-671-20mf, North American Philips Corp, AKG-200 B/D.

*Primary Examiner*—A. D. Pellinen

*Assistant Examiner*—S. D. Schreyer

*Attorney, Agent, or Firm*—McGlew and Tuttle

[57] ABSTRACT

A sound inlet for microphones to inhibit noises caused by sonic pressure changes occurring in shocklike pulses is disclosed which includes, in the area in front of the diaphragm walls which extend the microphone housing and have sound entry channels with openings at its outer surfaces that are closer to the diaphragm plane than those located at its inner surface. A cavity enclosed by the extending walls is closed off at the front of the housing by a cap-shaped or a plug-shaped closure.

8 Claims, 4 Drawing Figures

SOUND INLET FOR MICROPHONES

FIELD AND BACKGROUND OF THE INVENTION

The invention relates in general to microphones and, more particularly, to a new and useful sound inlet for microphones which inhibits noise due to sonic pressure changes, particularly sonic pressure shocks.

A sound inlet for microphones intended to solve the same problem is described in Austrian Pat. No. 290,645 which discloses filters disposed in front of the microphone diaphragm that have flow channels not arranged in straight lines. Since the acoustic inlet holding the filter is removable and the filter can be taken out for cleaning, a possibility of loss of the filter part or destruction through mechanical influences exists. Moreover, when the filter became dirty, a certain damping cannot be avoided. Such damping also adversely affects the frequency response of the microphone.

SUMMARY OF THE INVENTION

It is an object of the invention to create a sound inlet for microphones not afflicted by the disadvantages of the known sound inlets. According to the invention, this is accomplished by providing that, in the area of the diaphragm front, the walls which extend the microphone housing and have sound inlet channels with openings located outwardly in an orientation that is closer to the diaphragm plane than those located inwardly, and by providing that the cavity, enclosed by the extending walls, is closed off in front by the housing itself, through a cap-shaped or plug-shaped closure or the like.

The advantages of this design are due to its simplicity, which expresses itself first of all in a reduction of the production costs. Since the sound inlet channel sections are relatively large, clogging of the channels with dirt is completely impossible. Moreover, there are no components which could be misplaced or damaged. Advantageously, the cavity within the sound inlet, according to the invention, is largely filled by a rotation-symmetrical filler. On the one hand, this prevents undesired cavity resonances, or moves such resonances into an area where such resonances are desired, for instance where assaults on the frequency response of the microphone occur. In case the mere occurrence of a cavity resonance should be avoided, the cavity present inside the mouthpiece is filled with an open-pored foam filler such as polyurethane foam. If required, the channels may also be filled with a sound-permeable material so that larger particles cannot reach the interior of the sound inlet.

In the simplest case, the sound inlet for microphones, according to the invention, may be formed with a closed front face. It is also possible to provide the opening on the face with a cap-shaped or plug-shaped closure carrying on its inside, if required, the rotation-symmetrical filler which largely fills the cavity of the sound inlet. Since the sound inlet for microphones, according to the invention, may either be part of the microphone housing or form a detachable accessory, in the first case, accessibility of the of the interior of the sound inlet, e.g. for cleaning purposes, is expedient, while in the second case, i.e. when the sound inlet is detachable, such as a cap-shaped or plug-shaped closure is not absolutely necessary because access to the interior of the sound inlet through the attachment opening is automatically provided when the sound inlet is removed.

It is a further object of the invention to provide an improved sound inlet for a microphone having an elongated housing with a central longitudinal axis extending therethrough, and an electroacoustic transducer mounted within the housing with a diaphragm disposed perpendicular to the longitudinal axis of the housing, the improved sound inlet comprising a longitudinally extending wall portion attached to the housing and surrounding a cavity in front of the diaphragm, the wall portion having a plurality of channels extending at an oblique angle relative to the longitudinal axis through the wall portion from its outer side to its inner side adjacent the cavity, each of the channels having a first end opening on its inner side and a second end opening on its outer side, the second end opening being disposed closer to the diaphragm than the first end opening, and the wall portion including means for closing the end of the longitudinally extending wall portion remote from the housing.

It is a further object of the invention to provide an improved sound inlet for a microphone which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION

Figure 1:
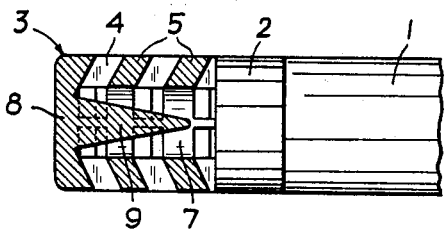
FIG. 1 is a schematic illustration of a sound inlet, according to the invention, mounted on a microphone, and illustrated in partial cross-sectional view.

In the schematic view of FIG. 1, an elongated microphone housing is designated 1. The housing part 2 contains the electroacoustic transducer whose diaphragm is disposed perpendicular to the longitudinal axis of the housing. A sound inlet 3, according to the invention, is arranged at the front of part 2. The sound inlet 3 essentially represents an extension of the microphone housing 1. The outside surface of the sound inlet 3, designed in the form of a cylinder, for example, has openings which define channels 4, extending through the cylinder wall, separated from each other by ribs 5. The channels 4 lead to the interior of the sound inlet 3 which has a profile that may be selected arbitrarily, but preferably from ring-shaped slits. It is essential to the invention that the outwardly located openings of the channels 4 (at the outer surface of the cylinder) be closer to the plane of the transducer diaphragm than the discharge openings of the channels 4 adjacent the interior of the sound inlet 3. Thus, the channels 4 extend at an oblique angle with respect to the elongated longitudinal microphone axis. Due to the obliquity of the channels 4, which are separated from each other by the narrow, lamellar ribs 5 in the illustrated embodiment, an air current, in a shock wave, is deflected past the microphone housing or past the sound inlet without eddy formation, and without interfering with the entry of the useful sound waves into the microphone.

Figure 2:
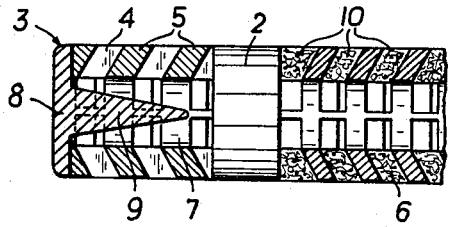
FIG. 2 is a schematic illustration, similar to FIG. 1, of another embodiment of the invention.

As illustrated in FIG. 2, the inventive sound inlet can also be applied to pressure gradient receivers in which sound is also fed to the reverse side of the diaphragm, it then being expedient, of course, to design the sound entry openings 6 located in the rear, behind the housing part 2, in the same manner as the channels 4 of the sound inlet 3 according to the invention. As in FIG. 1, the sound inlet 3 of FIG. 2 is part of the microphone housing 1. As already explained, it is expedient in this case to make the interior of the sound inlet 3 accessible for a cleaning operation, or the like, which may be possibly required. For this purpose, the front part of the sound inlet 3 may be removable, as shown in FIG. 2, where a cover 8 closes the front opening of the sound inlet.

Figure 3:
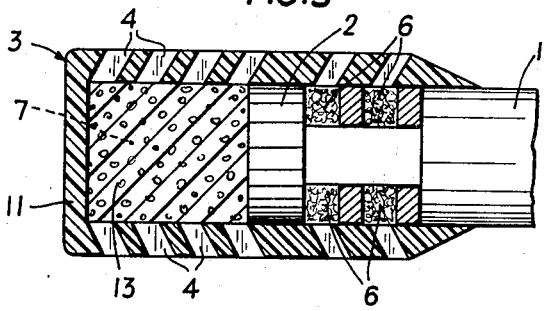
FIG. 3 is a schematic illustration, similar to FIG. 1, of still another embodiment of the invention.

The interior of the sound inlet 3 forms a cavity 7 which, under circumstances, can bring with it undesired housing resonances. In order to keep this cavity as small as possible or to give it a defined volume, a rotary part such as a cone 9, emanating from the face cover or cover 8 and largely filling the cavity 7, is provided in the embodiment examples shown in FIGS. 1 and 2. The microphone shown in FIG. 2 is supposed to be a pressure gradient receiver which also has rear sound entry openings 6 designed in the same manner as the channels 4 of the mouthpiece. So that the frictional resistance required for the component of a phasing member will come about in the rear openings 6, they may be filled with a tissue 10, for example. In contrast to the embodiment examples shown in FIGS. 1 and 2, in which the mouthpiece according to the invention is integrally joined to the microphone housing 1, FIG. 3 shows an embodiment example in which the mouthpiece 3 according to the invention is removable from the microphone or attachable to it. An advantageous and suitable material for such a mouthpiece is plastic, metal, rubber or nonrigid plastic. In this embodiment example, the sound inlet 3 is a cylindrical metal, rubber or nonrigid plastic cap 11 pushed over the front portion of the microphone 1. The cap 11 is long enough to cover the rear sound entry openings 6 also, wherefor it has breakthroughs in the appropriate places too. A polyurethane foam plug 13 is provided here to fill the cavity 7 in front of the microphone diaphragm for suppression of undesired cavity resonances.

It is also possible, of course, to make the plug 13 out of a suitable wind protection material to achieve an effective wind protection at the same time. The rear sound entry openings of the directional microphone are at least somewhat protected from wind noises by the friction material required for the required phase rotation.

Figure 4:
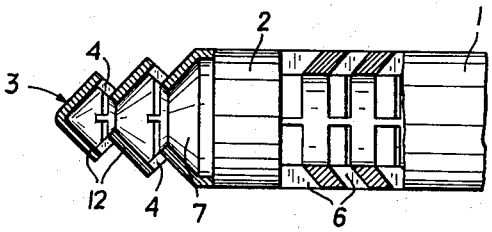
FIG. 4 is a schematic illustration, similar to FIG. 1, of even still another embodiment of the invention.

Another embodiment example is shown in FIG. 4, in which the sound inlet 3 is not cylindrical as in the previous examples, but conical. The channels 4 result from the oblique ribs or walls 12 whose inside edge moves closer and closer to the longitudinal axis of the microphone with increasing distance from the diaphragm on the inside of the sound inlet 3, until finally forming a point thereon. In this design, the cavity designated 7 in the other embodiment examples becomes so small as to no longer require a filler. Its operating principle, however, remains the same and is based on pulselike air currents gliding eddylessly off the oblique walls or ribs 12 defining the channels.

While specific embodiments of the invention have been shown and described in detail to illustrate the application of the principles of the invention, it will be understood that the invention may be embodied otherwise without departing from such principles.

What is claimed is:

1. An improved sound inlet for a microphone having an elongated housing with a central longitudinal axis extending therethrough, and an electroacoustic transducer mounted within the housing with a diaphragm disposed perpendicular to the longitudinal axis of the housing, the improved sound inlet comprising a longitudinally extending wall portion attached to the housing to define and surround a cavity in front of the diaphragm, said wall portion having a plurality of channels extending at an oblique angle relative to the longitudinal axis through the wall portion from its outer side to its inner side adjacent the cavity, each of said channels having a first end opening on the inner side and a second end opening on the outer side, the second end opening being disposed closer to the diaphragm than the first end opening, and said wall portion including means for closing that end of the longitudinally extending wall portion remote from the housing.

2. The improved sound inlet as set forth in claim 1, further comprising a rotationally symmetrical filler member attached to said wall portion centrally located in said cavity about the central longitudinal axis.

3. An improved sound inlet as set forth in claim 1, further comprising an open-pored foam material mounted in said cavity.

4. An improved sound inlet as set forth in claim 1, wherein said wall portion is inclined in a direction extending away from the diaphragm toward the central axis and has a conical shape.

5. An improved sound inlet as set forth in claim 1, wherein said sound inlet is detachably mounted to said housing.

6. An improved sound inlet as set forth in claim 1, wherein said channels comprise ring-shaped slots.

7. An improved sound inlet as set forth in claim 1, wherein said closing means is removably mounted to said wall portion.

8. An improved sound inlet according to claim 1, further comprising wall means mounted on the opposite side of the diaphragm having a second plurality of channels extending therethrough in parallel with the first mentioned channels.

* * * * *